US009138983B2

(12) United States Patent
Bryl et al.

(10) Patent No.: US 9,138,983 B2
(45) Date of Patent: Sep. 22, 2015

(54) SPREADER SYSTEM HAVING PRESSURE ROLL AND METHOD FOR CONTROLLING PRESSURE IN A PRESSURE ROLL

(75) Inventors: Derek A. Bryl, Webster, NY (US); Jason Mathew LeFevre, Penfield, NY (US); Douglas K. Herrmann, Webster, NY (US); Adam Douglas Ledgerwood, Geneva, NY (US)

(73) Assignee: Xerox Corporation, Norwalk, CT (US)

( * ) Notice: Subject to any disclaimer, the term of this patent is extended or adjusted under 35 U.S.C. 154(b) by 365 days.

(21) Appl. No.: 13/571,204

(22) Filed: Aug. 9, 2012

(65) Prior Publication Data

US 2014/0041542 A1 Feb. 13, 2014

(51) Int. Cl.

| | |
|---|---|
| ***B41M 7/00*** | (2006.01) |
| ***B41F 23/00*** | (2006.01) |
| ***B41F 13/08*** | (2006.01) |
| ***B41F 33/00*** | (2006.01) |

(52) U.S. Cl.

CPC ..... *B41F 33/00* (2013.01)

(58) Field of Classification Search

CPC ..... B41M 7/02; B41F 31/302
USPC ..... 492/4; 101/483; 347/101
IPC .... B41M 7/00; B41F 13/08, 23/00; B30B 3/02; F15B 21/00

See application file for complete search history.

(56) References Cited

U.S. PATENT DOCUMENTS

| | | | | |
|---|---|---|---|---|
| 2,970,339 | A * | 2/1961 | Hausman | 425/368 |
| 3,705,449 | A * | 12/1972 | Kuesters | 492/5 |
| 4,553,296 | A * | 11/1985 | Eibe | 492/4 |
| 4,679,287 | A | 7/1987 | Allard | |
| 4,757,585 | A | 7/1988 | Niskanen | |
| 4,791,863 | A * | 12/1988 | Vahatalo | 100/35 |
| 4,793,250 | A | 12/1988 | Niskanen | |
| 5,195,430 | A * | 3/1993 | Rise | 100/168 |
| 5,276,493 | A | 1/1994 | Hediger et al. | |
| 5,777,650 | A * | 7/1998 | Blank | 347/103 |
| 5,979,305 | A | 11/1999 | Wadzinski | |
| 2006/0086245 | A1 * | 4/2006 | Pitkanen et al. | 92/1 |

FOREIGN PATENT DOCUMENTS

| | | |
|---|---|---|
| GB | 824070 | * 11/1958 |

* cited by examiner

*Primary Examiner* — Leslie J Evanisko
(74) *Attorney, Agent, or Firm* — Ronald E. Prass, Jr.; Prass LLP

(57) ABSTRACT

A method and system for controlling a crown height associated with a nip profile includes adjusting pressure of a pressure roll. This may influence the shape of the pressure roll which may influence the nip profile. This may help prevent wrinkling and extend the life of the pressure roll. The pressure roll may be configured to have a varying wall thickness across a width of the pressure roll. The pressure roll may be used for a web application.

12 Claims, 10 Drawing Sheets

SPREADER SYSTEM HAVING PRESSURE ROLL AND METHOD FOR CONTROLLING PRESSURE IN A PRESSURE ROLL

Disclosed herein is a method and apparatus for manipulating the nip profile of a spreader nip when the spreader drum is coupled with a pressure roll.

Spreader system uses a nipped roller pair to spread the ink dots jetted to the media in a solid ink jet direct-to-paper process. The roller pair may be referred to as a spreader. The nipped roller pair may include a driven roll called the spreader drum and an idler roll called the pressure roll. The spreader drum may be manufactured using hard annodized aluminum. The pressure roll may be manufactured using a steel core with a thin elastomer coating. The spreader system may start to fail when the elastomer on the pressure roll develops edge marks. The edge marks may influence the profile of the nip. When the profile of the nip changes, the spreader may become less robust against web wrinkle.

SUMMARY

A method and apparatus for controlling operation of a pressure roll is disclosed. The method includes adjusting pressure of a pressure roll. This may influence the shape of the pressure roll which may influence the nip profile. This may help prevent wrinkling and extend the life of the pressure roll. The pressure roll may be configured to have a varying wall thickness across a width of the pressure roll. The pressure roll may be used for a web application.

DETAILED DESCRIPTION

Aspects of the embodiments disclosed herein relate to a method for controlling operation of a pressure roll in a spreader system, as well as corresponding system and computer-readable medium.

The disclosed embodiments may include a method for controlling a crown height associated with operation of a pressure roll. The method may include adjusting internal pressure of a pressure roll based on a nip profile. The pressure roll may include a custom profile on its inner wall.

The disclosed embodiments may further include a spreader system. The spreader system may include a spreader drum, and a pressure roll coupled with the spreader drum. The pressure roll may be configured to have an external surface with an elastomer coating and an internal surface having varying wall thickness across the width of the pressure roll.

The disclosed embodiments may further include a computer-readable medium storing instructions for controlling operation of a pressure roll. The instructions may include adjusting internal pressure of a pressure roll of a spreader system to create a nip profile. The pressure roll may include a custom profile on its inner wall.

Figure 1:
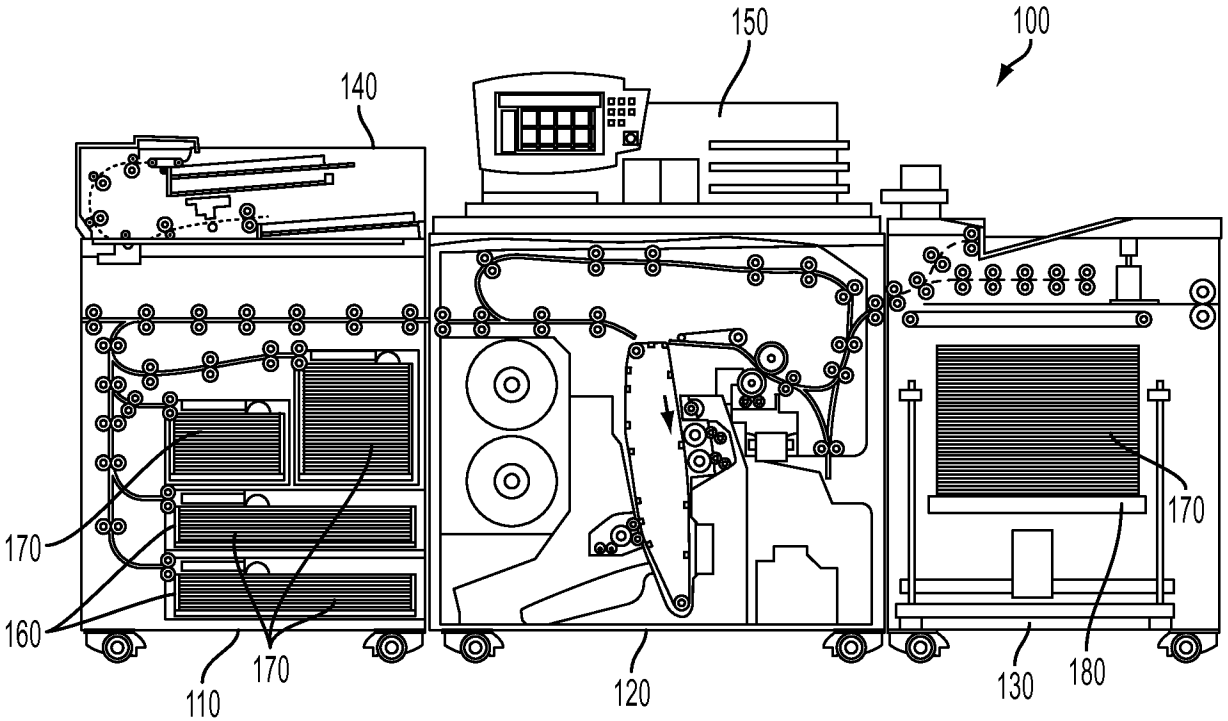
FIG. 1 is an exemplary diagram of an image production device, in accordance with one possible embodiment of the disclosure.

FIG. 1 is an exemplary diagram of an image production device in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine.

If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module includes any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in FIG. 1) of air pressure toward the top sheet or sheets in a media stack 170. Certain types of coated media are advantageously drawn from a media stack 170 by the use of an application of heat, such as by a stream of hot air (not shown in FIG. 1). Sheets of media drawn from a media stack 170 on a selected tray 160 may then be moved to the image production section 120 to receive one or more images thereon. Then, the printed sheet is then moved to output section 130, where it may be collated, stapled, folded, etc., with other media sheets in manners familiar in the art. The printed media may be place on a media stacker 180, for example.

Figure 2:
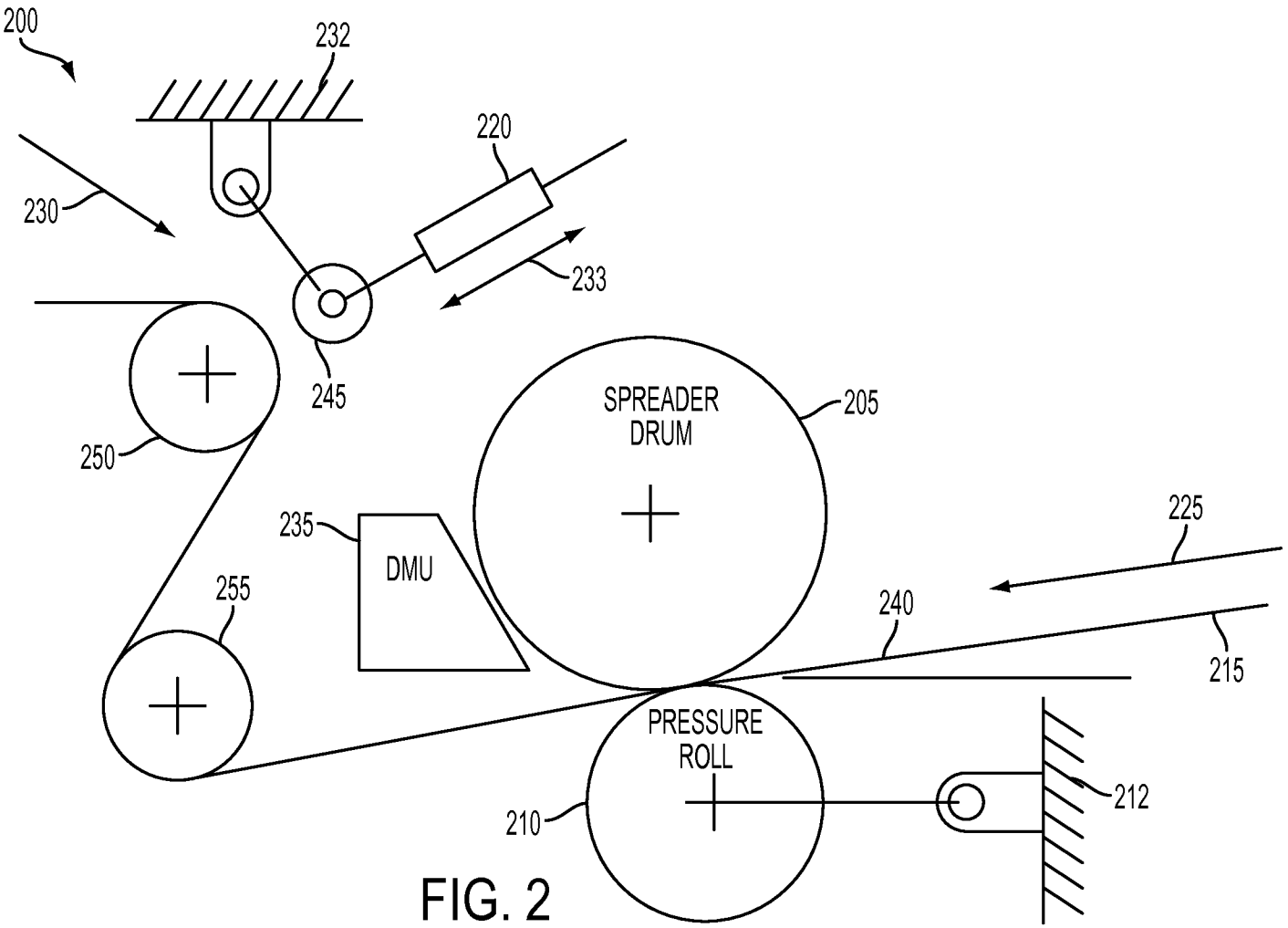
FIG. 2 is an exemplary diagram of a spreader system, in accordance with one possible embodiment of the disclosure.

FIG. 2 is an exemplary diagram of a spreader system, in accordance with one possible embodiment of the disclosure. Spreader system 200 may be implemented in the image production device 100 (illustrated in FIG. 1). The spreader system 200 may be configured to enable spread ink dots jetted to a media 215. For example, the media may be a web. The spreader system 200 may include a spreader drum 205, a pressure roll 210, and a drum maintenance unit (DMU) 235.

The spreader drum 205 may be an aluminum drum with hollow core and anodized outer surface. The temperature of the spreader drum 205 may be regulated using an internal liquid heat exchanger (not shown). The spreader drum may be constructed with two co-annular tubes between which makes up the water jacket within which liquid moves to thermally control the surface temperature. A teflon impregnated hard-annodized coating may be applied to the outer surface of the spreader drum 205. The DMU 235 may be a foam roll oil applicator with a single urethane metering blade.

The pressure roll 210 may be a hollow steel core with polyurethane outer surface. The outer surface may include an elastomer coating. For example, the pressure roll 210 may be constructed of stainless steel tube over which a 2.5 mm thick polyurethane elastomer coating may be applied. The modulus for the polyurethane elastomer coating may be nominally 72 Mpa, and its compliance with the surface of the spreader drum 205 makes up the spreader nip. The spreader drum 205 may be configured to operate as a driving roll, while the pressure roll 210 may be configured to operate as a driven roll. The pressure roll 210 may be coupled with a supporting member 212.

Directional arrow 225 shows an example path for web 215. When the spreader system 200 is engaged, the web 215 may come into contact with the spreader drum 205 and the pressure roll 210. When the spreader system 200 is disengaged, the web 215 may not be in contact with the spreader drum 205 and the pressure 210. A web path angle may be formed between the web 215 and a horizontal line associated with the spreader drum 205 and the pressure roll 210.

The spreader system 200 may also include a linear actuator 220 and two rollers 250 and 255. The linear actuator 220 may be coupled with a roller 245 which may be coupled with a supporting member 232. There may be a drive nip between the rollers 245 and 250. The bi-directional arrow 233 shows possible movements of the linear actuator 220. There may be a drive nip 230 between the rollers 245 and 250. The combination of the functions of the linear actuator 220 and the rollers 245-255 may cause feeding the web 215 through the spreader system 200.

When the spreader system 200 is engaged or loaded, a nip may be established between the spreader drum 205 and the pressure roll 210. The pressure associated with the nip may be referred to as a nip pressure. It may be desirable that the nip pressure along the nip is spread uniformly across the width of the web (or media) 215 to impart its effect uniformly across the width of the web 215. It may also be desirable that the nip width is uniform along the width of the web 215. When a pressure roll 210 becomes worn, the edge-wear marks in the elastomer may contribute to an added amount of crown (additional to the original amount of crown). This may place the nip in a compromised state as compared to the same configuration where there is no edge-wear. Failure of the pressure roll 210 may cause the web to wrinkle and reduce the life of the pressure roll 210. For example, a failing pressure roll 210 may have a life of 5 to 6 million linear feet of web 215 as compared to a target life of 15 million linear feet of web 215.

Figure 3A:
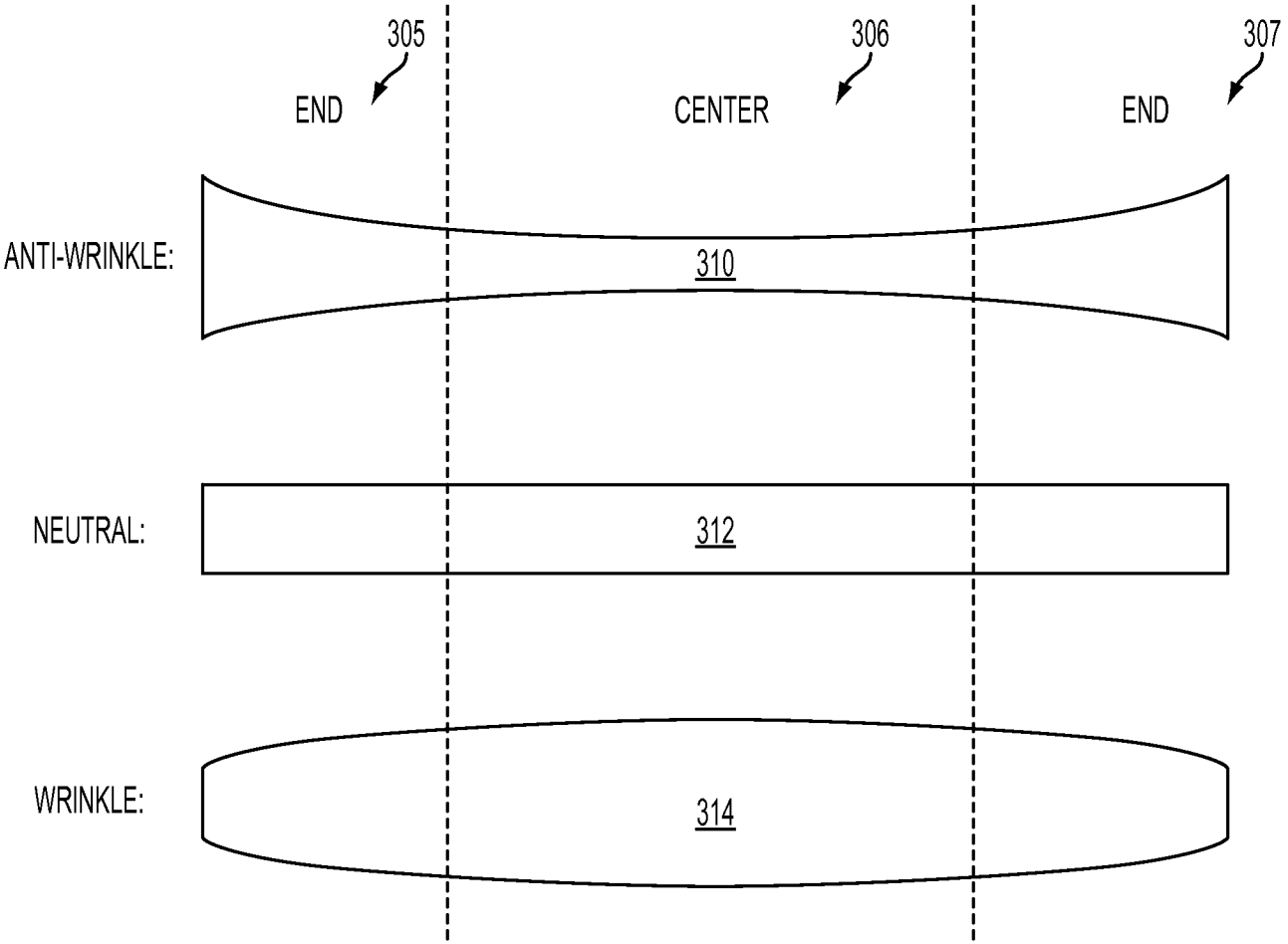
FIG. 3A is an exemplary diagram that illustrates three possible nip profiles, in accordance with one possible embodiment of the disclosure.

The pressure roll 210 may be associated with a nip profile. The nip profile may be a function of nip loads, spreader drum, pressure roll core geometry, and rubber profile (worn or not worn). As edge wear progresses, the nip profile may become narrower at the edges, and the pressure roll 210 may become more and more crowned. This increasing crowned condition may eventually lead to web wrinkling because the web 215 may be pulled towards the center. FIG. 3A is an exemplary diagram that illustrates three possible nip profiles, in accordance with one possible embodiment of the disclosure. The nip profile 310 may be associated with an anti-wrinkle nip profile. The nip profile 312 may be associated with a neutral nip profile. The nip profile 314 may be associated with a wrinkle nip profile. Each of the nip profiles 310, 312 and 314 may include a first end or edge section 305, a central section 306, and a second end or edge section 307.

Figure 3B:
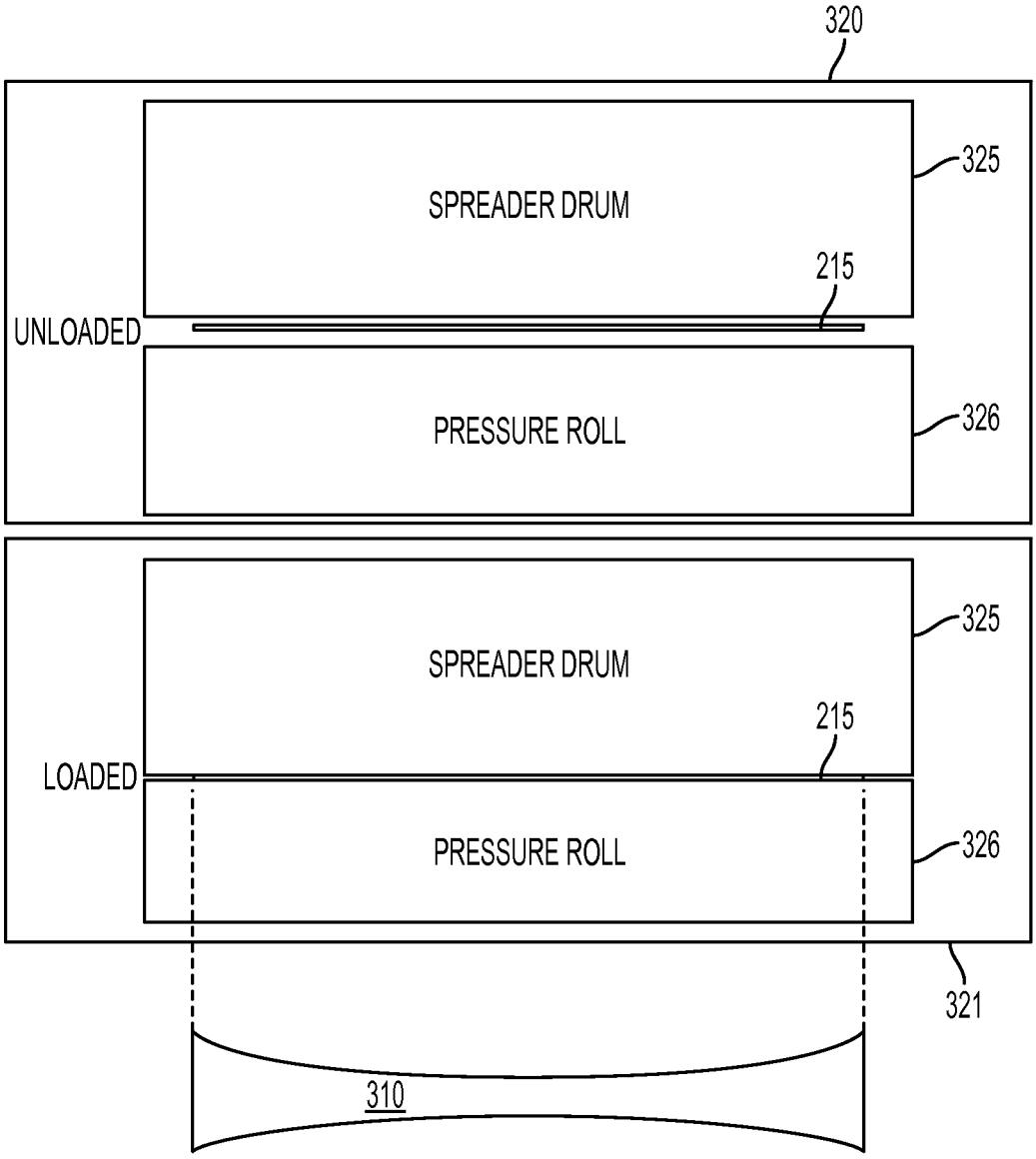
FIGS. 3B-3D are exemplary diagrams that illustrate different pressure rolls and nip profiles, in accordance with one possible embodiment of the disclosure.

The nip profile 310 may be associated with a pressure roll that is in its early life with low web mileage and may be more robust to stress conditions for wrinkle. The nip profile 310 may be considered to be in a good condition because it may prevent wrinkling. The elastomer crown for the pressure roll associated with the nip profile 310 may be at less than 0 μm. As shown, the nip profile 310 may appear to have an hour glass shape with the ends of nip wider than the center. An example of a pressure roll associated with the nip profile 310 is shown in FIG. 3B. A spreader drum 325 and a pressure roll 326 are shown with the web or media 215 in an unloaded state 320 and in a loaded state 321.

Figure 3C:
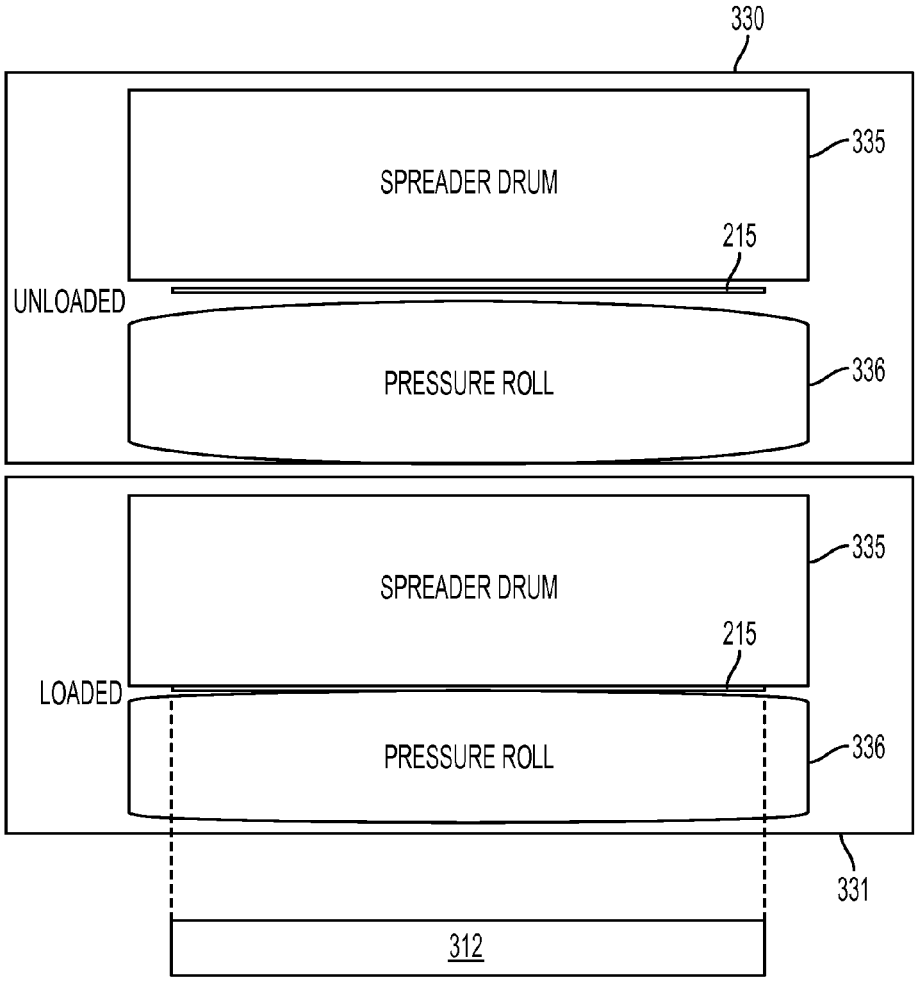

The nip profile 312 may be considered to be in a normal condition because it may prevent wrinkling but may be less robust to stress conditions for wrinkle as compared to the nip profile 310. An example of a pressure roll associated with the nip profile 312 is shown in FIG. 3C. A spreader drum 335 and a pressure roll 336 are shown with the web or media 215 in an unloaded state 330 and in a loaded state 331.

Figure 3D:
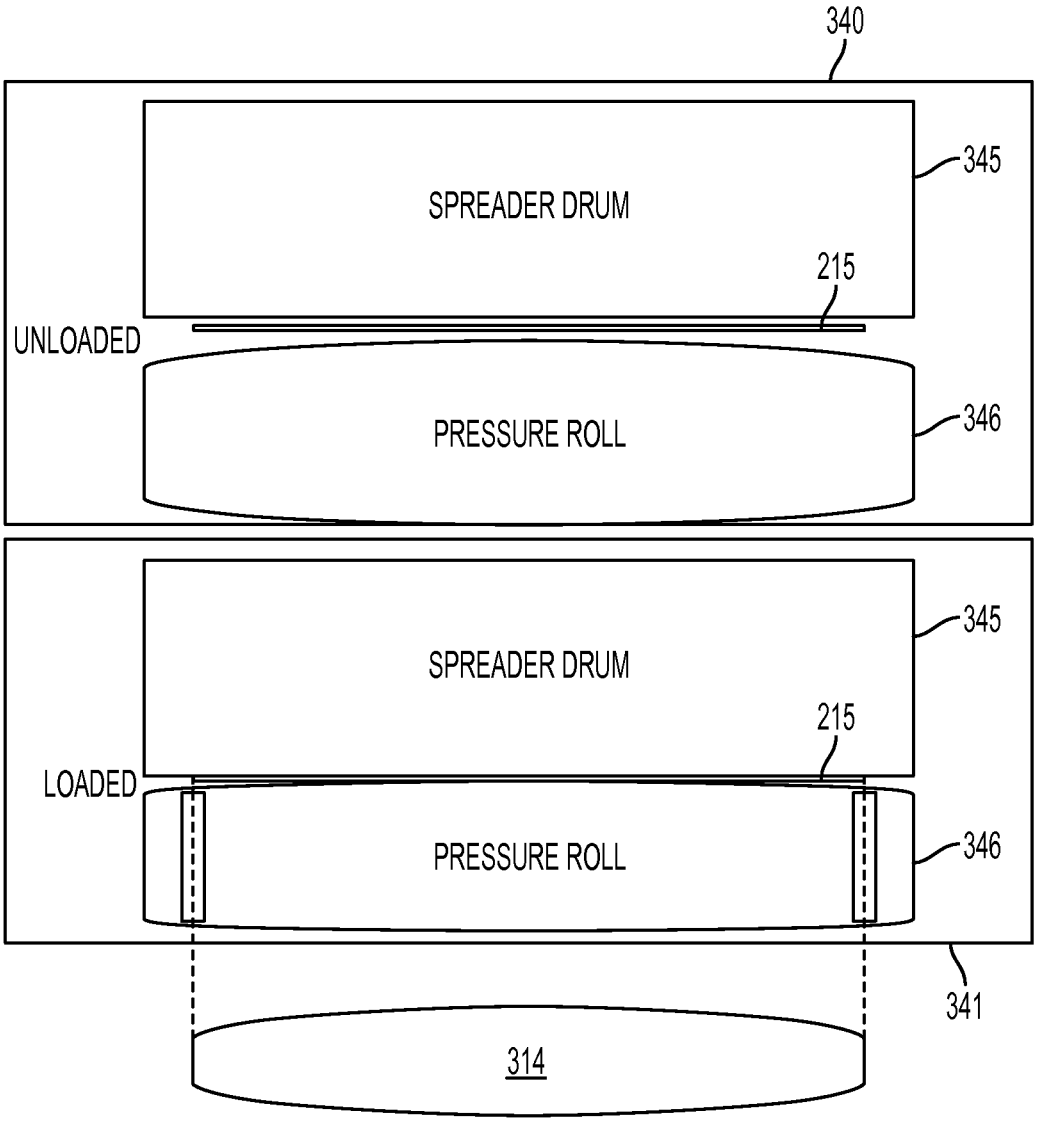

The nip profile 314 may have a higher crown as compared to the nip profile 310 and 312. Over a course of several millions linear feet of web, the nip profile 312 may no longer be uniform. The web 215 (shown in FIG. 2) may have worn grooves into the elastomer coating of the pressure roll. For example, the grooves at the end sections 305 and 307 of the nip profile 314 may be in the order of 20 to 30 μm deep giving it a barrel shape appearance. The nip profile 314 may be considered to be in a less than desirable state because it may cause wrinkling. An example of a pressure roll associated with the nip profile 314 is shown in FIG. 3D. A spreader drum 345 and a pressure roll 346 are shown with the web or media 215 in an unloaded state 340 and in a loaded state 341.

The nip profile may be determined manually. For example, the web may be monitored for wrinkling or stretching to collect feedback about the nip profile. This may include monitoring the width of the web as it runs through the spreader (or coming into and exiting the nip). When the web is wrinkling and all other process parameters are in-check, it may be inferred that the nip is not in a good condition. This may correspond to the pressure roll 346 shown in FIG. 3D. When the web appears to be taught, with no web disturbances (or web troughing) or wrinkles and all other process parameters are in-check, it may be inferred that the nip is in a range between a neutral condition and a good condition. This may correspond to the pressure roll 336 shown in FIG. 3C.

One possible method of extending the life of the pressure roll is based on manipulating the nip such that outer edges (i.e. inboard and outboard) have larger nip widths than the center of the nip, as shown with the nip profile 310. This may cause the nip profile to be less crowned. This method may stretch the web 215 toward the edges and reduce likelihood of web wrinkle, thus enabling a longer life of the pressure roll 210. Another possible method of extending the life of the pressure roll 210 is based on manipulating the nip profile to change the crown height of the elastomer coating of the pressure roll 210.

Figure 4:
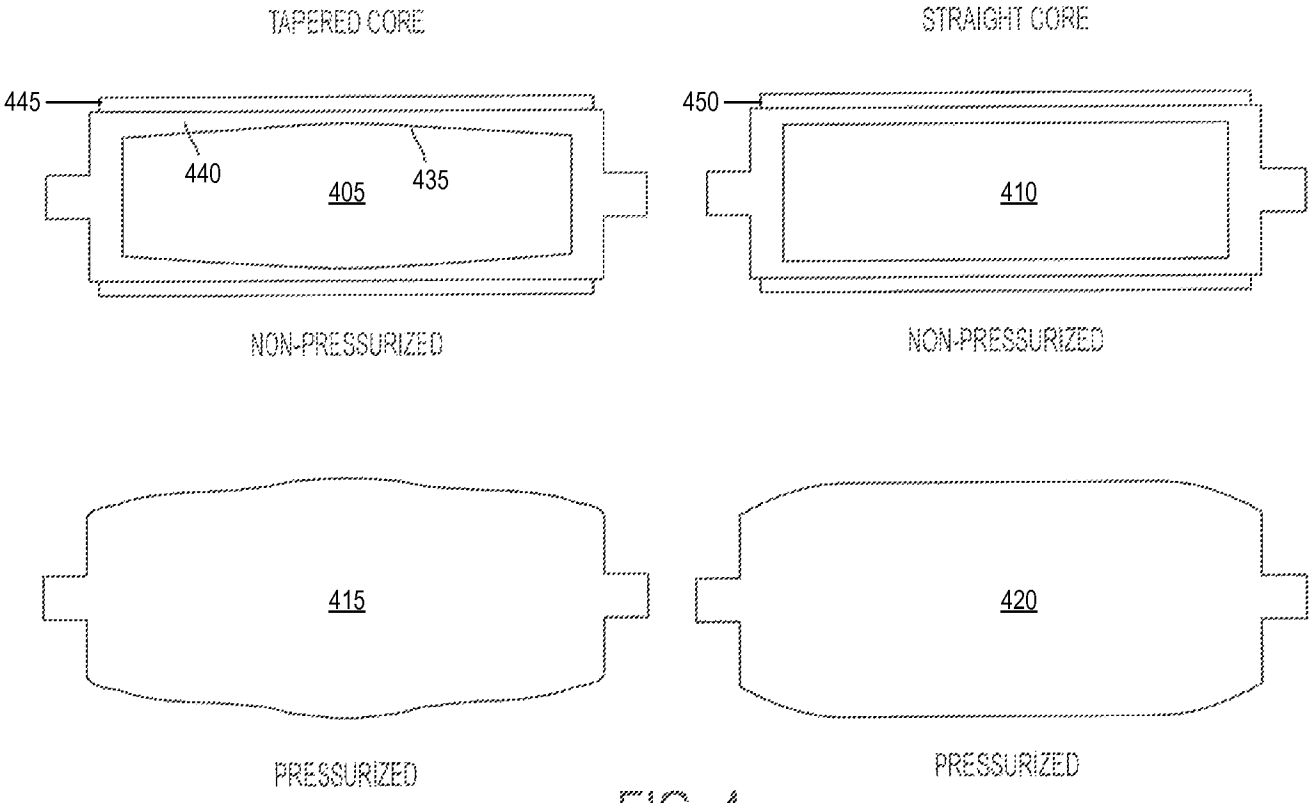
FIG. 4 is an exemplary diagram showing different deformed shapes of a pressure roll, in accordance with one possible embodiment of the disclosure.

FIG. 4 is an exemplary diagram showing different deformed shapes of a pressure roll, in accordance with one possible embodiment of the disclosure. Shown in this example are two pairs of pressure rolls. The first pair corresponds to a tapered core pressure roll in the non-pressurized state (pressure roll 405) and in the pressurized or deformed state (pressure roll 415). With the tapered core, the internal wall of the pressure roll 405 may be thinner at approximately the center area 435 and thicker at approximately the outer or edge area 440. The tapered core pressure roll 405/415 may include an elastomer coating 445 on an outer surface of the pressure roll 405/415. The second pair corresponds to a straight core pressure roll in the non-pressurized state (pressure roll 410) and in the pressurized or deformed state (pressure roll 420). With the straight core, the internal wall of the pressure roll 410 may have a straight profile and the wall thickness may be uniform. The straight core pressure roll 410/420 may include an elastomer coating 450 on an outer surface of the pressure roll 410/420. It may be noted that the deformation shown with the pressure roll 415 and 420 may be magnified for ease of conveying the effect of the internal pressure. By having the ability to control the internal pressure of the pressure roll, it may be possible to, over time, adjust the overall amount of crown on the pressure roll to achieve the desired nip state and counteract the effects of the wearing of the elastomer for the purpose of controlling wrinkle.

Figure 5:
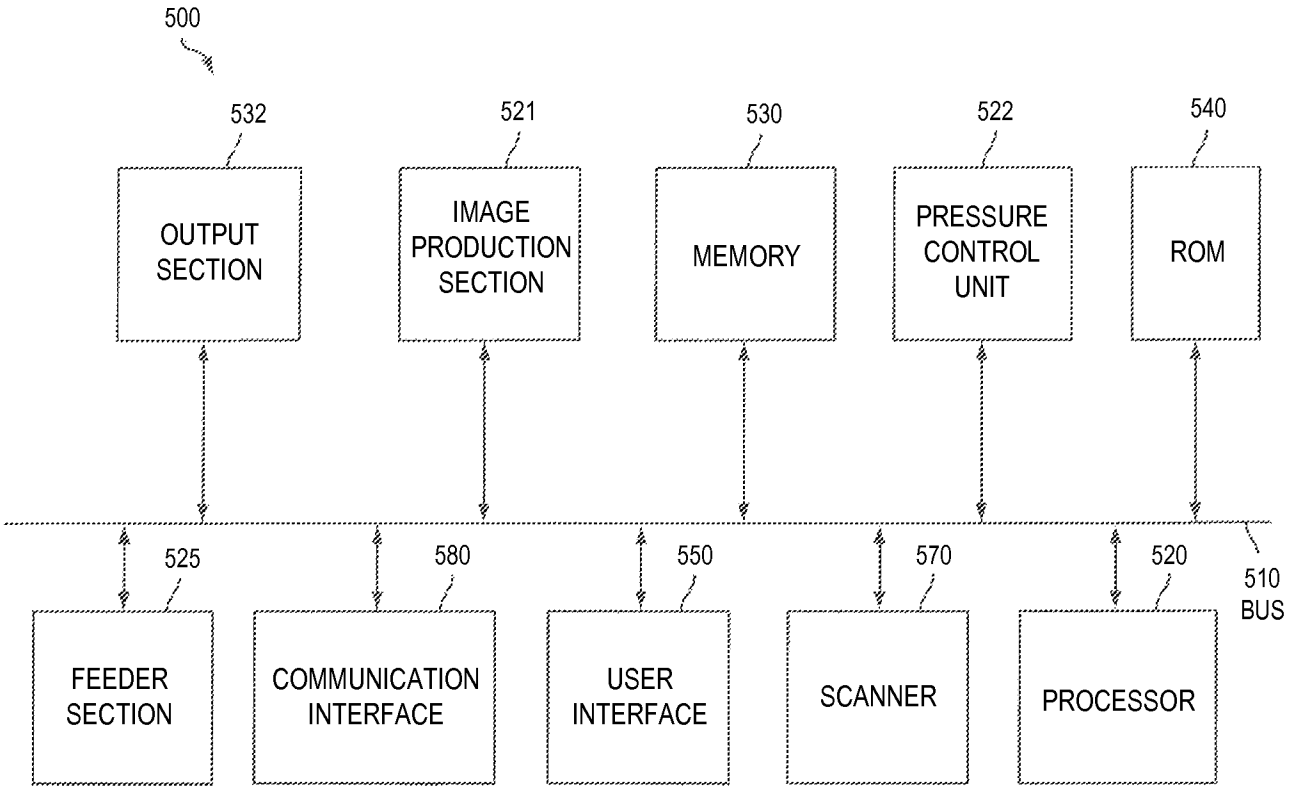
FIG. 5 is an exemplary diagram of the processing logic of the image production device, in accordance with one possible embodiment of the disclosure.

FIG. 5 is an exemplary diagram of the processing logic of the image production device 500, in accordance with one possible embodiment of the disclosure. The image production device 500 may include a bus 510, a processor 520, a memory 530, a read only memory (ROM) 540, a pressure control unit 522, a feeder section 525, an image production section 521, an output section 532, a user interface 550, a communication interface 580, and a scanner 570. Bus 510 may permit communication among the components of the image production device 500.

The processor 520 may include at least one conventional processor or microprocessor that interprets and executes instructions. The memory 530 may be a random access memory (RAM) or another type of dynamic storage device that stores information and instructions for execution by processor 520. The memory 530 may also include a read-only memory (ROM) which may include a conventional ROM device or another type of static storage device that stores static information and instructions for processor 520.

The communication interface 580 may include any mechanism that facilitates communication via a network. For example, the communication interface 580 may include a modem. Alternatively, communication interface 580 may include other mechanisms for assisting in communications with other devices and/or systems.

The ROM 540 may include a conventional ROM device or another type of static storage device that stores static information and instructions for processor 520. A storage device may augment the ROM and may include any type of storage media, such as, for example, magnetic or optical recording media and its corresponding drive.

The output section 532 may include one or more conventional mechanisms that output image production documents to the user, including output trays, output paths, finishing section, etc., for example.

The image production section 521 may include an image printing and/or copying section, a scanner, a fuser, etc., for example.

The scanner 570 (or image scanner) may be any scanner known to one of skill in the art, such as a flat-bed scanner, document feeder scanner, etc. The image scanner 570 may be a common full-rate half-rate carriage design and can be made with high resolution (600 dpi or greater) at low cost, for example.

The image production device 500 may perform such functions in response to processor 520 by executing sequences of instructions contained in a computer-readable medium, such as, for example, memory 530. Such instructions may be read into memory 530 from another computer-readable medium, such as a storage device or from a separate device via communication interface 580.

The user interface 550 may include one or more conventional mechanisms that permit a user to input information to and interact with the image production device 500, such as a keyboard, a display, a mouse, a pen, a voice recognition device, touchpad, buttons, etc., for example.

The pressure control unit 522 may be configured to apply internal pressure to change the appearance of the pressure roll. Examples of pressurized pressure rolls are shown in FIG. 4. This may enable changing the nip profile of the pressure roll. For some embodiments, the pressure roll may be configured to operate as a pressure vessel that can withstand an internal pressure and stretch using a pressurized hydraulic fluid. The application of the pressure may be controlled by the pressure control unit 522. The pressure may change the crown height and thereby may change the nip profile. The intent is to control the crown on the pressure roll, which may be directly related to the nip pressure distribution. For example, by lowering the internal pressure of the pressure roll, the crown height may be decreased to shift the large nip profile from the center area back to the edges. The adjustment of the crown height and the shift of the large nip profile to the edges may enable regaining latitude against web wrinkling.

As discussed above, it may be desirable to have slightly higher nip pressure on the outside of the web to create tension across the web. For some embodiments, the thickness of core of the pressure roll may vary depending on the areas where the adjustment of the crowning may be performed using the internal pressure. For example, when an area of the pressure roll is more sensitive to crown height adjustment, the internal wall thickness of that area may be less than other areas of the pressure roll. The pressure roll may have an internal profile due to the variation of the internal wall thickness. When the elastomer coating on the pressure roll begin to wear, and the nip pressure at the outer edges of the web may begin to decrease, the internal pressure of the pressure roll may be lowered to decrease the crown and increase the pressure out to the edge of the web. The change in the internal pressure may be performed by the pressure control unit 522.

Figure 6:
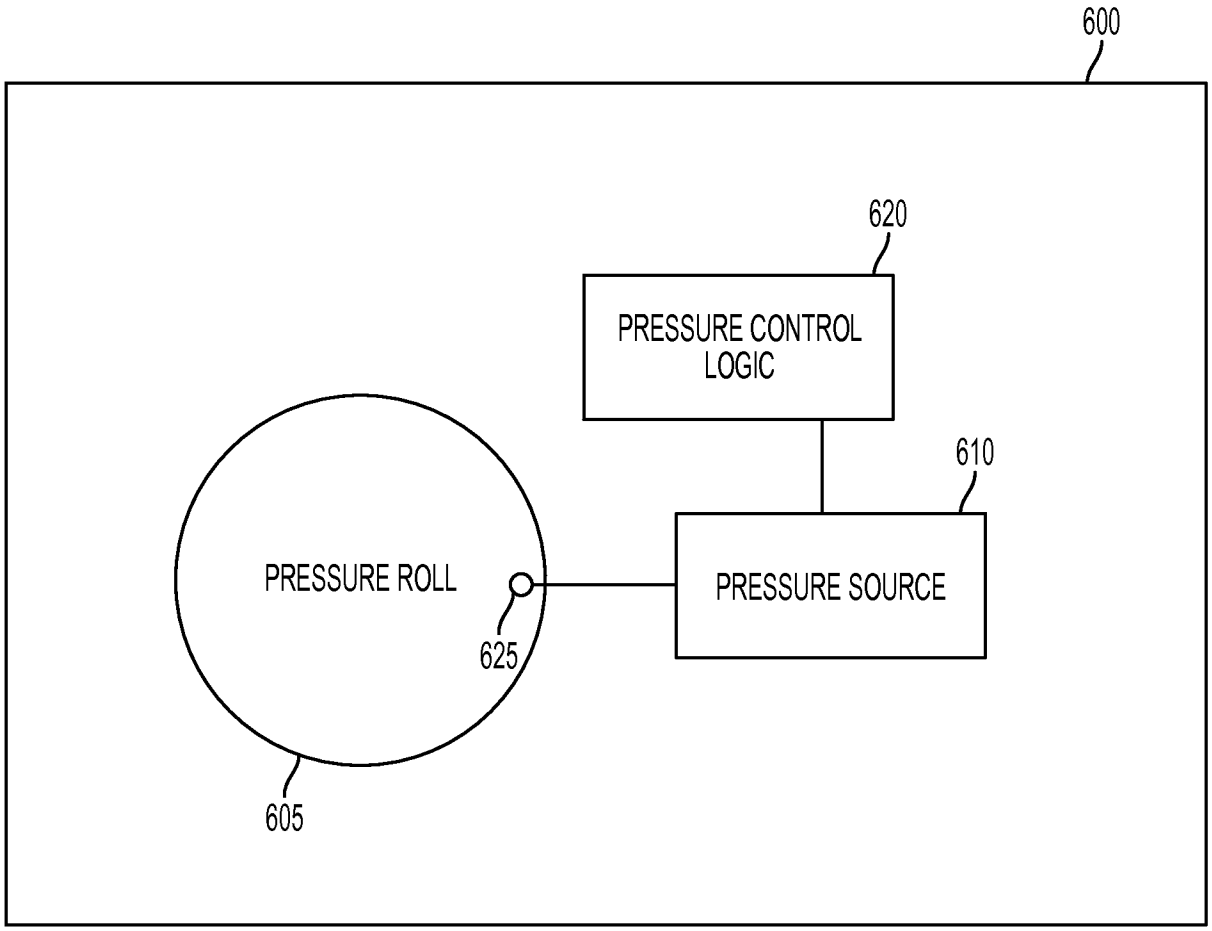
FIG. 6 is an exemplary diagram showing components associated with an adjustable crown pressure roll system, in accordance with one possible embodiment of the disclosure.

FIG. 6 is an exemplary diagram showing components associated with an adjustable crown pressure roll system, in accordance with one possible embodiment of the disclosure. The adjustable crown pressure roll system 600 may include a pressure roll 605 having an internal profile, a pressure source 610 and pressure control logic 620.

The pressure roll 605 may be configured to have internal walls with thickness variation. This may enable using the internal pressure to control any possible deformed shape of the pressure roll. Custom profiles may be created to control the amount of deflection across the pressure roll 605. For example, the custom profile may be a tapered profile where the wall thickness at the mid-section of the pressure roll 605 may be thinner than the edge sections. This may enable more expansion in the mid-section and therefore more nip pressure at the mid-section of the pressure roll 605 than at the edges. Similarly, reducing the internal pressure of the pressure roll 605 may transfer the high nip pressure from the mid-section to the outer part of the pressure roll 605.

The pressure control logic 620 may determine how the appearance of the pressure roll 605 may be adjusted. For example, the adjustment may be made as a function of roller age, based on data from prior experiments in which the wear rate (depth, width, etc.) has been characterized as a function of linear feet of paper processed through the nip, and the paper width, weight, type, etc. The adjustment may involve applying internal pressure to certain areas of the pressure roll 605. The pressure may be increased or decreased depending on where the wear occurs and whether more or less crowning is desirable. The pressure may be provided by the pressure source 610. For some embodiments, the pressure control logic 620 may use hydraulic loading with couplings or connector 625 that may be used to connect to the pressure roll 605. The connection may occur when the adjustable crown pressure roll system 600 is not powered on. Disconnection may occur before the adjustable crown pressure roll system 600 is powered on.

Figure 7:
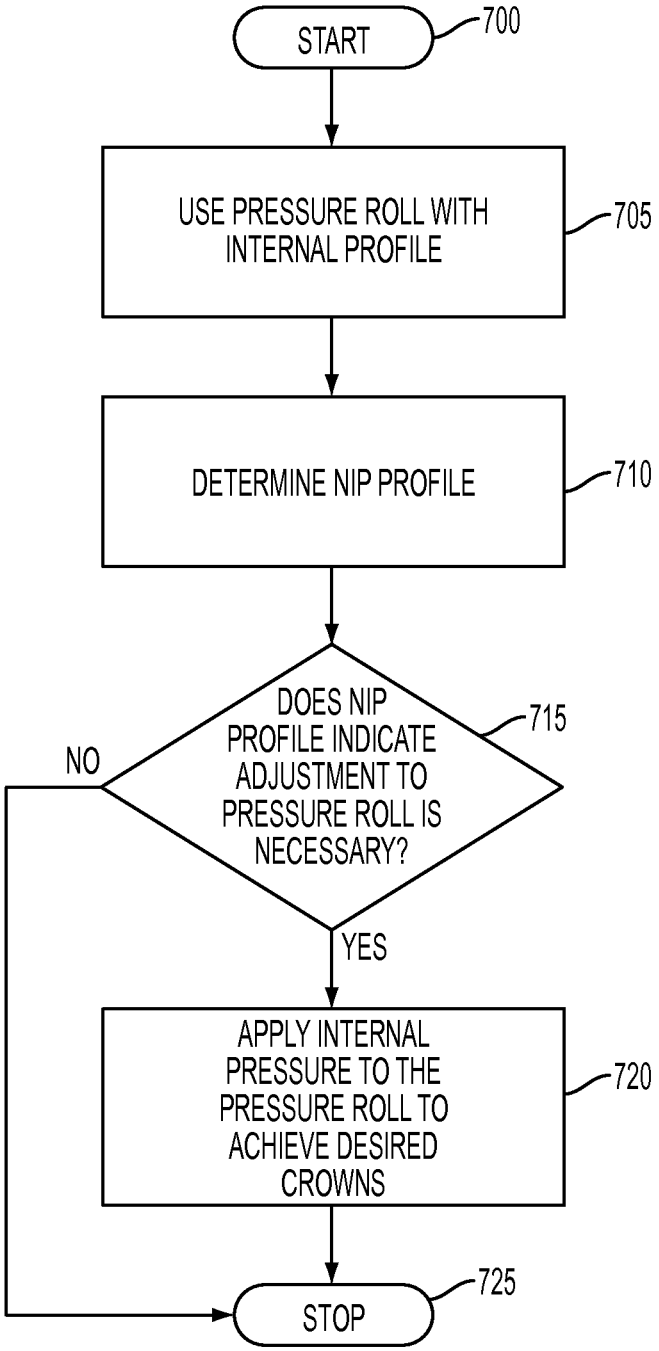
FIG. 7 is an exemplary flowchart of operations that control the internal pressure of a pressure roll, in accordance with one possible embodiment of the disclosure.

FIG. 7 is an exemplary flowchart of operations that control the internal pressure of a pressure roll, in accordance with one possible embodiment of the disclosure. The process may begin at block 700. The process may be performed by the adjustable crown pressure roll system 600 described and shown in FIG. 6. At block 705, a pressure roll with an internal profile may be used. The internal profile may be a tapered profile (shown in FIG. 4). At block 710, the nip profile may be determined. This may be performed manually as discussed above. Based on the nip profile, the pressure control logic may be controlled to perform the necessary pressure adjustment, as shown in block 715. For example, the adjustment may be necessary when the nip profile indicates that there is undesirable crowning which may reduce the efficiency of the adjustable crown pressure roll system. If the adjustment is necessary, the process may flow from block 715 to 720 where internal pressure may be applied to the pressure roll until the undesirable crowning is corrected. If no adjustment is necessary, the process may flow from block 715 to block 725 where the process may stop.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A computer-implemented method for controlling operation of a pressure comprising:

providing a pressure roll that is configured to contact a spreader drum in an image forming device to form a spreader nip between the pressure roll and the spreader drum, the pressure roll having an elastomer coating on an external surface, and having an inner wall enclosing a single internal pressure cavity in the pressure roll, the inner wall having a tapered configuration that renders a thickness of the inner wall to be relatively thinner in a central portion and relatively thicker toward each end portion in the axial direction;

collecting nip profile information for the spreader nip; and applying pressure control via a pressure control unit to adjust an internal pressure of the single pressure cavity in the pressure roll to modify a nip profile for the spreader nip based on the collected nip profile information.

2. The method of claim 1, wherein the pressure control unit adjusts the internal pressure of the single pressure cavity in the pressure roll using a pressurized hydraulic fluid.

3. The method of claim 1, wherein the internal pressure of the single pressure cavity in the pressure roll is adjusted by decreasing the internal pressure to reduce a crown height in an axial center of the pressure roll based on the collected nip profile information.

4. The method of claim 1, wherein the internal pressure of the single pressure cavity in the pressure roll is adjusted by increasing the internal pressure to increase a crown height in an axial center of the pressure roll based on the collected nip profile information.

5. The method of claim 1, wherein the collected nip profile information includes information on wear in the elastomer coating on the external surface of the pressure roll and the internal pressure of the single pressure cavity in the pressure roll is adjusted to compensate for the wear in the elastomer coating on the external surface of the pressure roll.

6. The method of claim 1, wherein the pressure control unit adjusts the internal pressure of the single pressure cavity in the pressure roll to cause a change to a shape of the single pressure cavity in the pressure roll.

7. A spreader system in an image forming device, comprising:

a spreader drum;

a pressure roll that contacts the spreader drum to form a spreader nip between the pressure roll and the spreader drum, the pressure roll having an elastomer coating on an external surface and an internal surface enclosing a single pressure cavity, the internal surface having varying wall thickness across an axial direction of the pressure roll; and a pressure control unit that applies pressure control to adjust an internal pressure of the single pressure cavity in the pressure roll to modify a nip profile for the spreader nip based on collected nip profile information.

8. The spreader system of claim 7, further comprising:

a pressure source controlled by the pressure control unit to generate pressure to adjust the internal pressure of the single pressure cavity in the pressure roll to deform a shape of the pressure roll.

9. The spreader system of claim 8, wherein the pressure source includes pressurized hydraulic fluid.

10. The spreader system of claim 8, wherein the pressure control unit increases the internal pressure of the single pressure cavity in the pressure roll to raise a crown height associated with the nip profile of the spreader nip.

11. The spreader system of claim 8, wherein the pressure control unit decreases the internal pressure of the single pressure cavity in the pressure roll to lower a crown height associated with the nip profile of the spreader nip.

12. The spreader system of claim 8, wherein the pressure control unit controls the pressure generated from the pressure source to change a shape of a crown at an axial center of the pressure roll based on the collected nip profile information.

* * * * *